US005108090A

United States Patent [19]

Reed

[11] Patent Number: 5,108,090

[45] Date of Patent: Apr. 28, 1992

[54] BACK EXERCISING APPARATUS

[76] Inventor: Michael S. Reed, 5835 E. Anderson Dr., Scottsdale, Ariz. 85254

[21] Appl. No.: 712,286

[22] Filed: Jun. 10, 1991

[51] Int. Cl.[5] ..... A63B 21/00

[52] U.S. Cl. ..... 482/5; 482/72; 482/907

[58] Field of Search ..... 272/72, 134, 141, 903, 272/126, 120, 144, 130

[56] References Cited

U.S. PATENT DOCUMENTS 3,323,366 6/1967 De Lorme et al. .
3,992,004 11/1976 Feron et al. .
4,844,453 7/1989 Hestilow .
4,877,239 10/1989 Dela Rosa .

FOREIGN PATENT DOCUMENTS 1097873 1/1961 Fed. Rep. of Germany ..... 272/72

*Primary Examiner*—Stephen R. Crow
*Attorney, Agent, or Firm*—Henderson & Sturm

[57] ABSTRACT

An exercise apparatus (10) for stretching a users paraspinal and leg muscles including a leg immobilizing unit (11) having an adjustable extension unit (12) to which is pivotally attached a reciprocating telescoping unit (15) which is controlled by a control unit (14) for causing the reciprocating unit (13) to expand and contract to stretch the users paraspinal and leg muscles.

5 Claims, 3 Drawing Sheets

BACK EXERCISING APPARATUS

TECHNICAL FIELD

The present invention relates to the field of exercizing devices in general, and in particular to an apparatus specifically designed to provide exercise for a users back, while immobilizing the users legs.

BACKGROUND ART

This invention was the subject matter of Document Disclosure Program Registration No. 259,693 which was filed in the United States Patent and Trademark Office on Aug. 9, 1990.

As can be seen by reference to the following U.S. Pat. Nos. 3,323,366; 3,992,004; 4,844,453; and 4,877,239; the prior art is replete with myriad and diverse muscle stretching exercise devices.

While all of the aforementioned prior art constructions are more than adequate for the basic purpose and function for which they have been specifically designed, these patented devices are inadequate to provide the specific results produced by the apparatus that forms the basis of the present invention.

As most physical therapist and other health care professionals are all too painfully aware at the current time there is not available an integrated exercise apparatus that will immobilize the users legs while allowing the user to passively and selectively stretch the paraspinal and leg muscles while the users knees are being held in a captive condition.

As a consequence of the foregoing situation, there has existed a longstanding need for a new type of back exercise apparatus that will address these oversights in the prior art constructions while also providing an exercise apparatus that will produce beneficial as well as long sought after results; and, the provision of such an apparatus is a stated objective of the present invention.

DISCLOSURE OF THE INVENTION

Briefly stated, the back exercising apparatus that forms the basis of the present invention comprises in general a leg immobilizing unit; an adjustable extension unit; a pivoted reciprocating telescoping unit; and, a control unit for determining the direction and extent of travel of the telescoping unit.

The leg immobilizing unit comprises in general an adjustable framework member provided with foot rest elements on one end and knee capturing elements on the other end.

The adjustable extension unit extends forwardly from the adjustable framework member and comprises two relatively slidable tubular members having a locking element that will secure the slidable tubular members at a desired effective length.

As will be explained in greater detail further on in the specification, the reciprocating telescoping unit is pivotally secured to the forward end of the extension unit and is disposed rearwardly towards the user. In addition the reciprocating unit comprises in general an inner generally stationary shaft member; an outer relatively moveable shaft member and a motor controlled reversible screw actuator member operatively connected between the inner and outer tubular members.

Furthermore, the control unit comprises control members which are provided on handle elements that are connected on the inboard end of the outer tubular member; wherein, the control members govern the duration and direction of rotation of the reversible screw actuator member to retract and extend the reciprocating telescoping unit at the users discretion.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
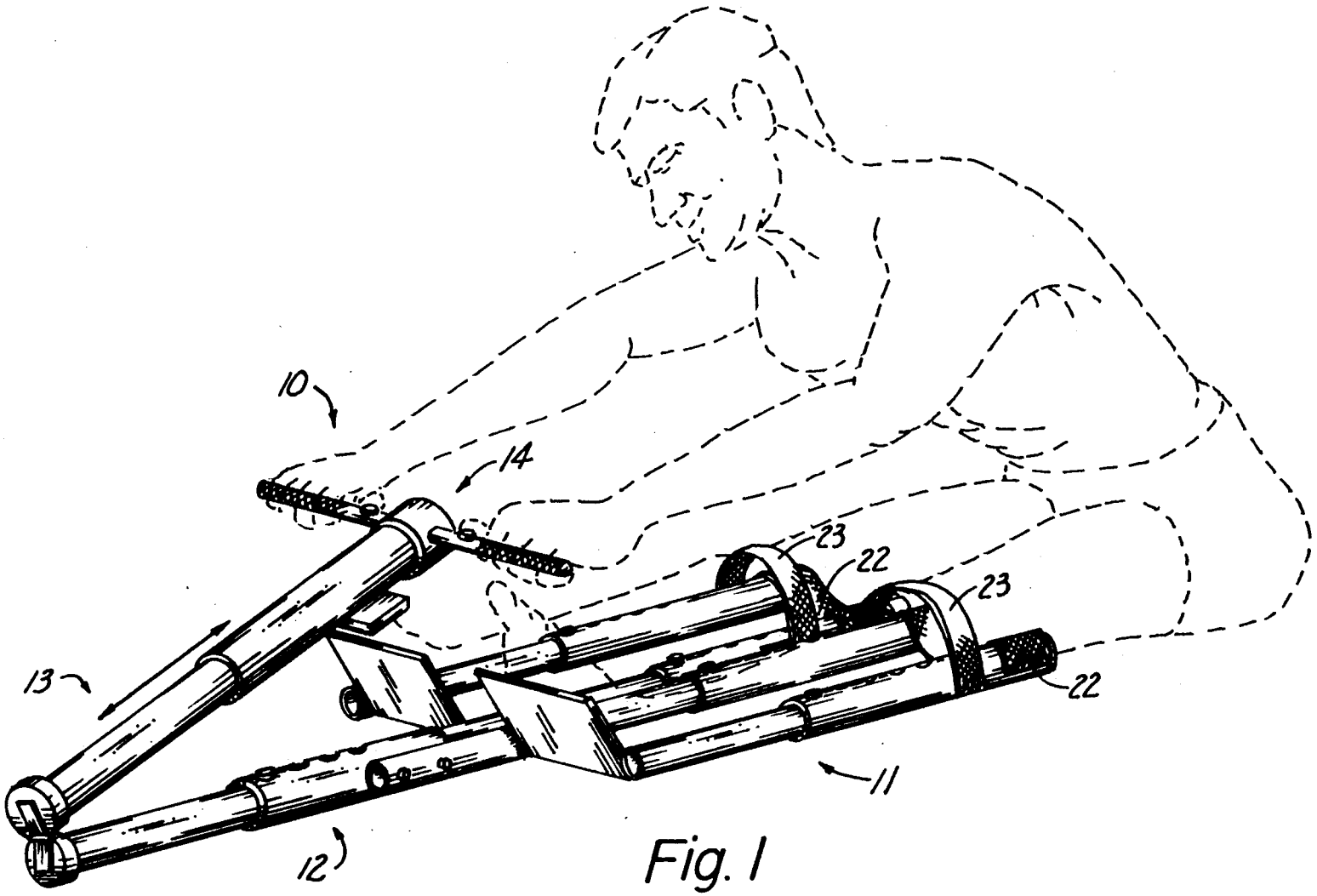
FIG. 1 is a perspective view of the apparatus in use.

As can be seen by reference to the drawings, and in particular to FIG. 1, the back exercising apparatus that forms the basis of the present invention is designated generally by the reference numeral (10). The apparatus (10) comprises in general a leg immobilizing unit (11); an adjustable extension unit (12); a pivoted reciprocating telescoping unit (13); and a control unit (14). These units will now be described in seriatim fashion.

Figure 5:
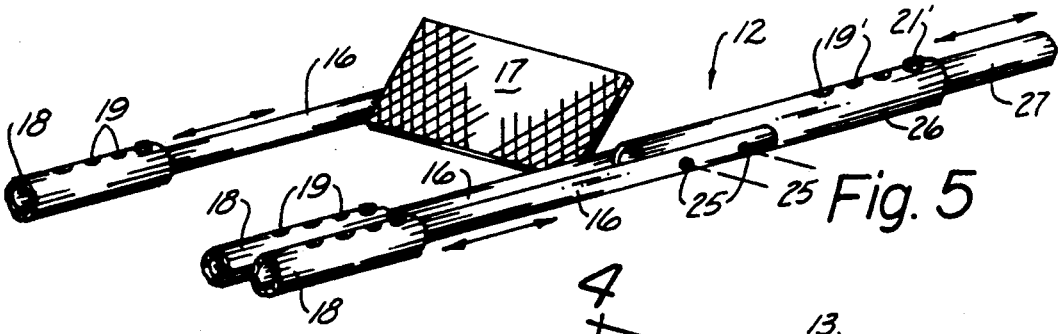
FIG. 5 is an isolated perspective view of a portion of the leg immobilizing and adjustable extension units.
Figure 2:
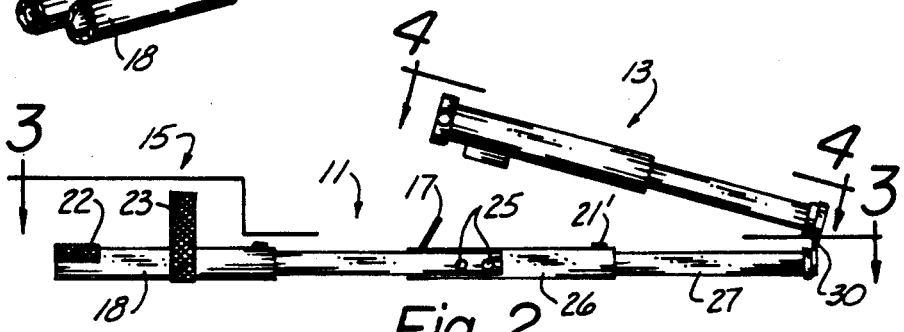
FIG. 2 is a side plan view of the apparatus.
Figure 3:
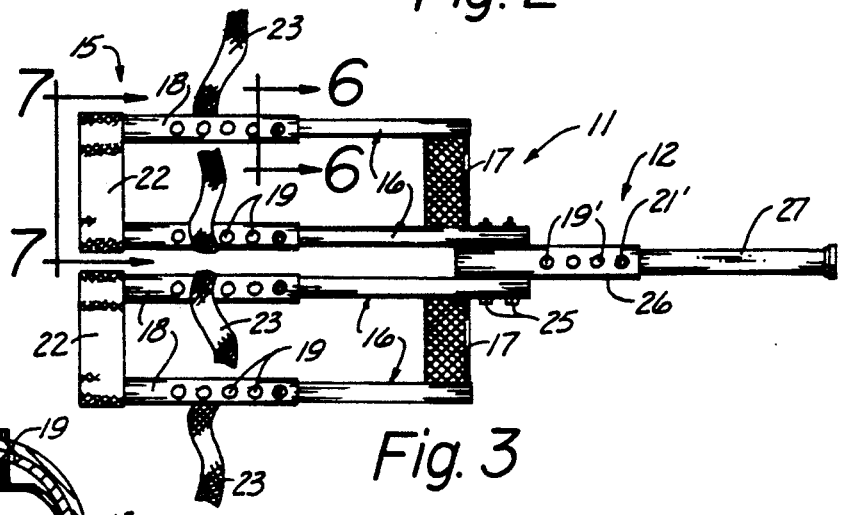
FIG. 3 is a top plan view of the leg immobilizing and the adjustable extension units.

As shown in FIGS. 2, 3 and 5, the leg immobilizing unit (11) comprises an adjustable length tubular framework member (15) having four generally stationary tubular rod elements (16) connected together into two pairs on their forward ends by foot rest elements (17).

Figure 6:
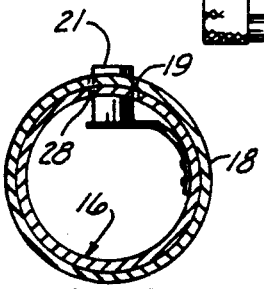
FIG. 6 is a cross sectional view taken through line 6—6 of FIG. 3.
Figure 4:
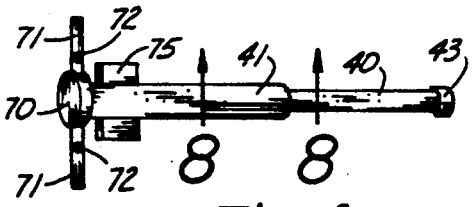
FIG. 4 is an isolated top plan view of the reciprocating unit and the control unit.

In addition each of the rod elements (16) is slideably engaged on their rearward ends by hollow tubular pipe segments (18) having a plurality of spaced apertures (19) formed therein; wherein, the plurality of apertures (19) are registrable with a single aperture (20) formed in the rod elements (16) as depicted in FIG. 6.

As can also be seen by reference to FIG. 6, the interior of the tubular rod elements (16) are provided with a spring loaded button member (21) which allows the rod elements (16) and the pipe segments (18) to be selectively positioned relative to one another to vary the effective length of the tubular framework member (15) in a well reorganized fashion.

Figure 7:
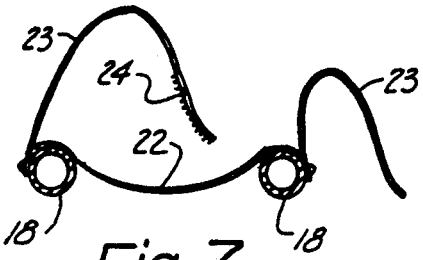
FIG. 7 is an end view taken through line 7—7 of FIG. 3.

As shown in FIGS. 1,3, and 7, the rearward ends of the pairs of tubular pipe segments (18) are provided with flexible sling members (22) which join the tubular pipe segments (18) into distinct pairs. In addition each of the tubular pipe segments (18) is provided with strap segments (23) having cooperating hook and loop fasteners (24) which will join the strap segments (23) together in the conventional manner.

Turning now to FIGS. 2, 3 and 5, each of the pairs of rod elements (16) and pipe segments (18) serve as individual leg immobilizing segments when the patient rests their legs on the slings (22) and engages the straps (23) over the patients legs proximate the knees as depicted in FIG. 1.

Still referring to FIGS. 2, 3 and 5, it can be seen that the adjustable extension unit (12) is operatively connected intermediate the two pairs of rod elements (16) by a pair of lateral fasteners (25); wherein, the adjustable extension unit (12) comprises a first enlarged diameter tubular element (26) and a second reduced diameter tubular element (27); wherein, the enlarged diameter tubular element (26) is provided with a plurality of apertures (19') which cooperate with another spring loaded button (21') in the reduced diameter tubular element (27), as described previously with regard to the framework member (15), to vary the effective length of the adjustable extension unit (12).

Figure 9:
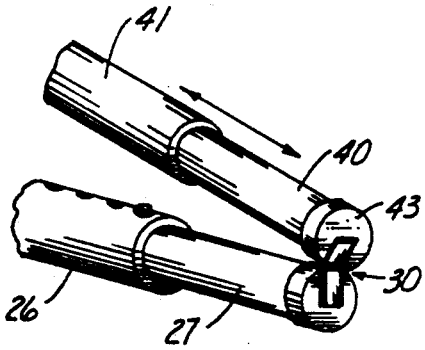
FIG. 9 is an isolated perspective view of the pivotal connection between the adjustable extension unit and the reciprocating unit.

In addition as shown in FIGS. 2 and 9 the forward end of the reduced diameter tubular segment (27) is provided with a hinge member (30) which operatively attaches the adjustable extension unit (12) to the pivoted reciprocating telescoping unit (13).

As shown in FIGS. 9 through 12, the reciprocating telescoping unit (13) comprises an inner hollow shaft member (40) an outer hollow shaft member (41) and a reversible screw actuator member (42) which is operatively connected to the inner (40) and outer (41) shaft members.

In addition the forward end of the inner shaft member (40) is provided with a cap element (43) which is operatively attached to one of the hinge plates (31) of the hinge member (30) such that the inner shaft member (40) can be pivoted in a rearward direction relative to the hinge pivot pin (32) in a well recognized fashion.

Figure 11:
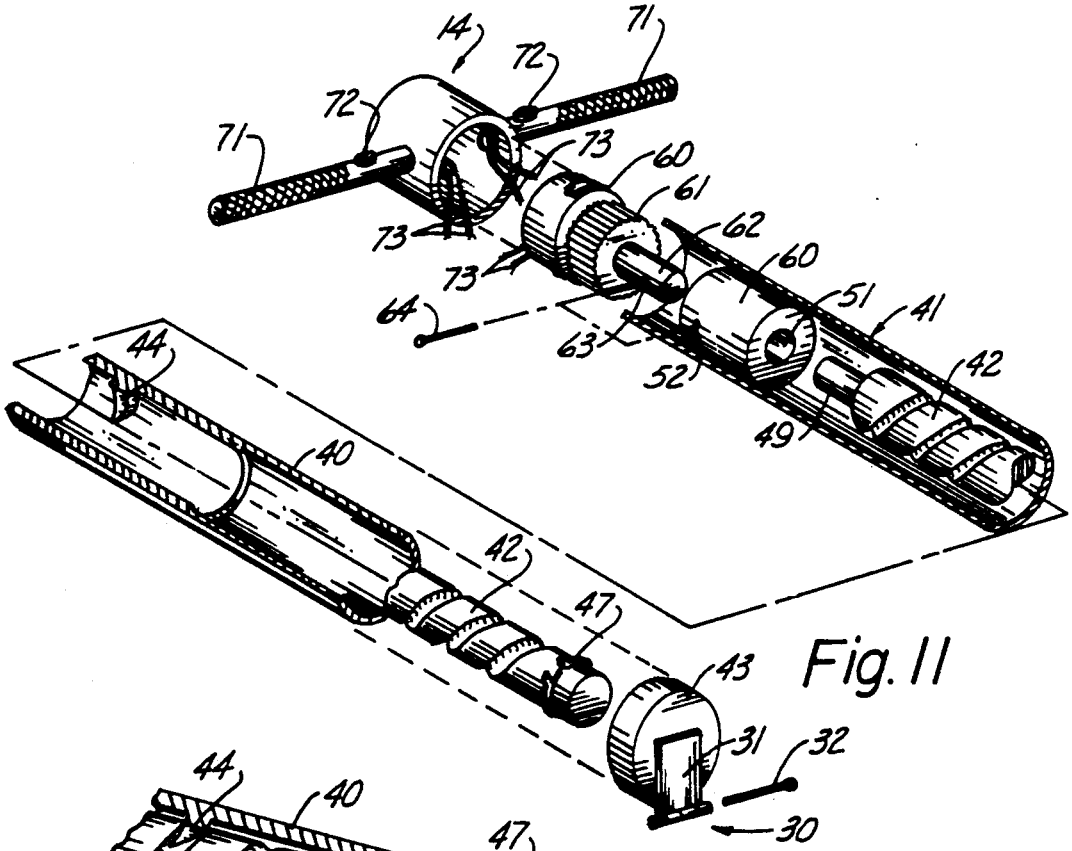
FIG. 11 is an exploded perspective view of the reciprocating unit and the control unit; and, FIG. 12 is an isolated detail view of the operative engagement between the screw actuator member and the interior of the inner tubular member.
Figure 12:
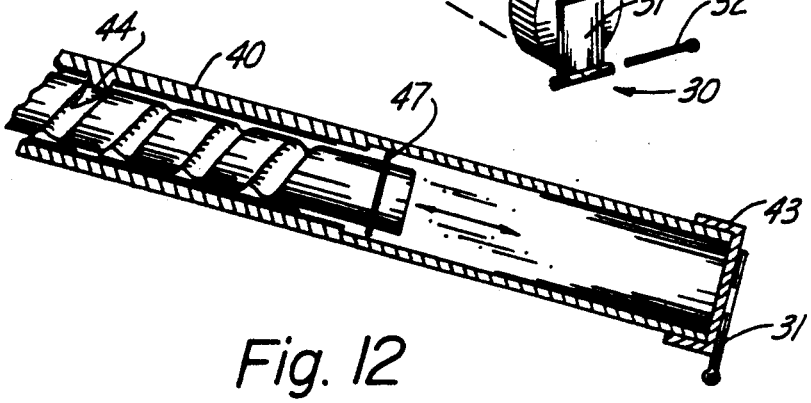

As can also be seen by reference to FIGS. 11 and 12, the interior surface of the inner shaft member (40) is provided with both a spiral thread (44) which is dimensioned to fit in the spiral recess (45) on the screw actuator member (42); and, a locking ring (47) which is dimensioned to limit the rearward direction of travel of the screw actuator member (42).

As can be seen by reference to FIG. 11, the rearward end of the screw actuator member (42) is provided with an axle stub (40) which is dimensioned to be received in a suitably dimensioned central aperture (51) in a drive coupling (50). Furthermore, the rearward end of the outer shaft member (41) is further provided with a reversible motor (60) equipped with a reduction gear box (61) and a drive stem (62) having an elongated aperture (63) formed therein; wherein the operative engagement between the drive stem (62) and the drive coupling (50) is established by a drive pin (64) which extends through a suitably dimensioned radial bore (52) formed in the drive coupling (50) and the elongated aperture (63) formed in the drive stem (62).

Figure 10:
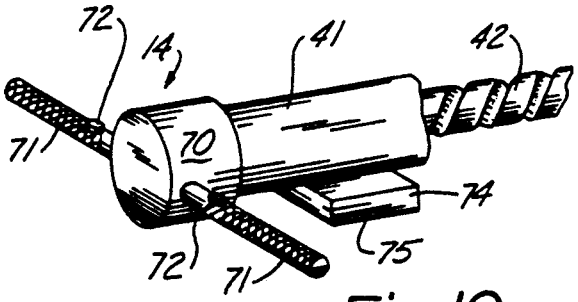
FIG. 10 is an isolated perspective view of the control unit and a portion of the reversible screw actuator member.

Turning now to FIGS. 10 and 11, it can be seen that the control unit (14) comprises an enlarged hub member 70 having a pair of hollow handle elements (71); wherein, the hollow handle elements (71) are provided with control buttons (72). In addition the control buttons (72) are connected by electrical wires (73) to the reversible motor (60) to govern the direction and duration of the rotation of the screw actuator member (42) to contract and expand the combined length of the inner (40) and outer (41) shaft members.

Furthermore, the control unit (14) also comprises a power source (74) such as a battery pack (75) to provide electrical current to the reversible motor (60); and the reversible motor (60) is secured within the hub member (70) which is in turn operatively affixed to the rearward end of the outer shaft member (41).

By now it should be appreciated that when a person, as depicted in phantom in FIG. 1, employs the apparatus (10) in its intended manner, the leg immobilizing unit (11) and the extension unit (12) are adjusted in length to accommodate the patients particular body dimensions; wherein, the patients knees are then immobilized by the sling (22) and strap (23) arrangement.

Figure 8:
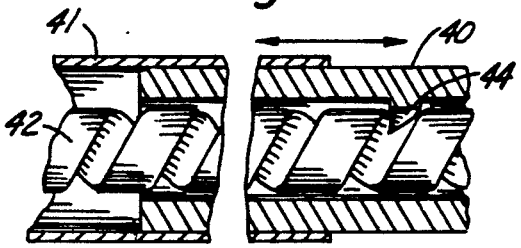
FIG. 8 is a cross-sectional view taken through line 8—8 of Fig.

At this point the patient grasps the handle elements (71) to position the pivoted reciprocating unit (13) at a desired angular orientation; and then, the control buttons (72) are selectively manipulated to cause the screw actuator member (42) to rotate in the clockwise and counter clockwise directions to expand and contract the reciprocating telescoping unit (13) as depicted in FIG. 8, which will stretch the users paraspinal and leg muscles in a well recognized fashion.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. An exercise apparatus for stretching a users paraspinal and leg muscles; wherein, the apparatus comprises:

a leg immobilizing unit including an adjustable length framework member having foot rest elements formed on one end and leg restraining means formed on the other end for captively engaging the users knees in a locked disposition, a pivoted reciprocating telescoping unit operatively associated with the leg immobilizing unit; wherein, the telescoping unit comprises an outer shaft member having handle means, an inner haft member and means for causing the outer and inner shaft members to reciprocate relative to one another;

a control unit including means for governing said means for causing the outer and inner shaft members to reciprocate relative to one another; whereby a user immobilized in said leg unit stretches by grasping said handle means while said shaft members reciprocate.

2. The apparatus as in claim 1; wherein, said means for causing the outer and inner shaft members to reciprocate relative to one another includes: a screw actuator member; a reversible motor; and a power source.

3. The apparatus as in claim 1; wherein, the pivoted reciprocating unit is operatively associated with the leg immobilizing unit via an adjustable extension unit including a first enlarged diameter tubular element and a second reduced diameter tubular element which is slidable disposed within the said first tubular and the extension unit is rigidly connected on one end to the leg immobilizing unit and provided with a hinge member on the other end; wherein, the hinge member is operatively attached to the reciprocating telescoping unit.

4. The apparatus as in claim 2; wherein, the means for governing said means for causing the outer and inner shaft members to reciprocate relative to one another comprises control buttons connected by electrical wiring to said reversible motor.

5. The apparatus as in claim 4; wherein, said control unit comprises a hub member mounted on one end of the reciprocating telescoping unit; wherein, the hub member is provided with a pair of handle elements; and, wherein the control buttons are mounted on the handle elements.

* * * * *